US005590491A

United States Patent [19]

Piltingsrud

[11] Patent Number: 5,590,491

[45] Date of Patent: Jan. 7, 1997

[54] WINDOW OPERATOR WITH DIAL INTERFACE

[75] Inventor: Stephen M. Piltingsrud, Owatonna, Minn.

[73] Assignee: Truth Hardware Corporation, Owatonna, Minn.

[21] Appl. No.: 328,032

[22] Filed: Oct. 24, 1994

[51] Int. Cl.[6] ..... E05F 11/24

[52] U.S. Cl. ..... 49/342; 49/339

[58] Field of Search ..... 49/339, 341, 342, 49/345; 475/176; 74/89.16

[56] References Cited

U.S. PATENT DOCUMENTS

| | | | |
|---|---|---|---|
| Re. 34,230 | 4/1993 | Tucker et al. . | |
| 2,819,065 | 1/1958 | Jones | 49/341 X |
| 2,824,735 | 2/1958 | Stavenau et al. . | |
| 3,032,330 | 5/1962 | Stavenau . | |
| 3,044,311 | 7/1962 | Gagnon | 49/342 X |
| 3,258,874 | 7/1966 | Martin . | |
| 3,422,575 | 1/1969 | Armstrong . | |
| 4,241,541 | 12/1980 | Van Klompenburg et al. . | |
| 4,253,276 | 3/1981 | Peterson et al. . | |
| 4,266,371 | 5/1981 | Erdman et al. . | |
| 4,305,228 | 12/1981 | Nelson . | |
| 4,445,794 | 5/1984 | Sandberg . | |
| 4,505,601 | 3/1985 | Sandberg et al. . | |
| 4,617,758 | 10/1986 | Vetter . | |
| 4,781,416 | 4/1988 | Johnson et al. | 475/176 X |
| 4,823,508 | 4/1989 | Allen . | |
| 4,840,075 | 6/1989 | Tucker . | |
| 4,845,830 | 7/1989 | Nolte et al. . | |
| 4,887,392 | 12/1989 | Lense | 49/342 X |
| 4,895,038 | 1/1990 | Pipon et al. | 475/176 X |
| 4,937,976 | 7/1990 | Tucker et al. . | |
| 5,102,377 | 4/1992 | Spanski | 475/176 X |
| 5,152,103 | 10/1992 | Tucker et al. . | |
| 5,199,216 | 4/1993 | Vetter et al. . | |
| 5,272,837 | 12/1993 | Nolte et al. . | |

OTHER PUBLICATIONS

*Gear Handbook*, Darle W. Dudley, © 1963, pp. 3–34–3–43.

*Primary Examiner*—Kenneth J. Dorner
*Assistant Examiner*—Jerry Redman
*Attorney, Agent, or Firm*—Wood, Phillips, VanSanten, Clark & Mortimer

[57] ABSTRACT

An operator for controlling pivoting of a window sash relative to a window frame including dual arms which pivot relative to one another to move the window sash. A drive input pivotally drives a drive member which is eccentric about its pivot axis, where the drive input includes recesses spaced from the input pivot axis and engageable by a user's fingers to manual pivot the drive input. A drive ring gear is pivotable relative to the drive member and includes two axially spaced sets of gear teeth. The dual arms are secured to separate ring gears which are respectively associated with the two gear teeth sets. The drive ring gear is moved eccentrically relative to the pivot axis by the eccentric drive member whereby at least some of the teeth of the first set of drive ring gear teeth are disengaged from the teeth of its associated arm ring gear and at least some of the teeth of the second set of drive ring gear teeth are disengaged from the teeth of its associated arm ring gear. At least one of the first and second arm ring gears or the first and second sets of drive ring gear teeth have different numbers of teeth.

49 Claims, 3 Drawing Sheets

WINDOW OPERATOR WITH DIAL INTERFACE

BACKGROUND OF THE INVENTION

1. Technical Field

The present invention is directed toward window operators, and more particularly toward window operators for controlling movement of a window sash relative to the window frame.

2. Background Art

There are, of course, any number of different types of window (and other closure) operators which are well known in the art. Examples of such operators are shown, for example, in Van Klompenburg U.S. Pat. No. 4,136,578, Van Klompenburg et al. U.S. Pat. No. 4,241,541, Peterson et al. U.S. Pat. No. 4,253,276, Erdman et al. U.S. Pat. No. 4,266,371, Nelson U.S. Pat. No. 4,305,228, Sandberg U.S. Pat. No. 4,346,372, Vetter U.S. Pat. No. 4,497,135, Tacheny et al. U.S. Pat. No. 4,521,993, Vetter U.S. Pat. No. 4,617,758, Allen U.S. Pat. No. 4,823,508, Tucker U.S. Pat. No. 4,840,075, Nolte et al. U.S. Pat. No. 4,843,703, Nolte et al. U.S. Pat. No. 4,845,830, Tucker U.S. Pat. No. 4,894,902, Tucker et al. U.S. Pat. No. 4,937,976, Nolte et al. U.S. Pat. No. 4,938,086, Berner et al. U.S. Pat. No. 4,945,678, Tucker et al. U.S. Pat. No. 5,054,239, Tucker et al. U.S. Pat. No. 5,152,103, and Vetter et al. U.S. Pat. No. 5,199,216.

Generally speaking, such operators have used a variety of linkages in combination with suitable hinge structures, where the operator linkages are actuated by rotation of a manual or powered drive connected to the linkage through assorted gear drives. The linkage used in one type of operator, known as a dual arm operator (as shown, for example, in Van Klompenburg et al. U.S. Pat. No. 4,241,541), includes two arms selectively pivotable relative to each other about a common axis with the other ends of the arms suitably linked to a window sash whereby such relative pivoting causes the sash to move as desired.

Unfortunately, the gear drives typically used with window operators require that there be some clearance or backlash between the gear teeth so that the different gears can fit together without interference or binding. As a result, such operators allow the connected sash a significant amount of unrestricted and undesirable free travel. The amount of such free travel can be reduced (though not entirely eliminated) by using gears manufactured with low tolerances, but the cost of such gears typically increases as the tolerances are lowered.

The need for high quality (and therefore generally high cost) gears in prior art operators is further enhanced by the high loads typically incurred by such window operators. Such loads arise, for example, when breaking the weatherstrip seal during initial opening of the sash and when closing the window sash to seal about the entire periphery of the weather strip. As a result, it is has been necessary to use high strength materials such as suitably hardened metals in the drive train of the operator. Also, given the characteristics of such high strength materials, it has typically been necessary to protect the materials from corrosion, with such corrosion protection being difficult to ensure given the long expected useful life of such operators, particularly where the operators are used in corrosive environments such as found in seaside dwellings.

Notwithstanding the above strength and durability requirements, it is also desirable to minimize the size of the operator in order to minimize as much as possible the intrusion of the operator into the open viewing area provided through the pane opening of the sash. Conventionally, manual window operators have handles which can be manually pivoted, which such handles extending into the room and, to varying degrees, the window viewing area. Not only do such handles affect the aesthetics of the window, but they also are susceptible to damage and/or can themselves cause damage if, for example, accidentally bumped. Further, such susceptibility to bumping can also create a risk that the operator might be accidentally and unknowingly moved to an undesirable position where, for example, forced entry might be easier, or where a tight weather seal is not provided. In order to minimize such risks, folding handles have been used in some installations, where the handle when not in use can be folded to a position in which its extension into the room (and thus its susceptibility to accidental bumping) is reduced. Such structures can, however, adversely impact the ease of manual operation of the operator when used to change the window position.

Prior art operators have to varying degrees been unable to address all of the above design constraints in a suitable manner.

The present invention is directed toward overcoming one or more of the problems set forth above.

SUMMARY OF THE INVENTION

In one aspect of the present invention, an operator for controlling pivoting of a window sash relative to a window frame is provided, including a linkage pivotable about an axis and connectable to a window sash for controlling movement of a sash relative to a window frame, a drive input pivotable about a first axis fixable relative to a window frame, the drive input including a recess spaced from the first axis and engageable by a user's finger to manually pivot the drive input, and means drivably connecting the drive input to the linkage, the connecting means including a reduction ratio of at least 25:1.

In another aspect of the present invention, a window operator is provided with dual arms pivotable relative to one another to move the window sash. A drive input drives a pivotable drive member, which drive member is eccentric about its pivot axis. A first ring gear is secured to one of the arms. A drive ring gear is pivotable relative to the drive member and is moved eccentrically relative to the pivot axis by the eccentric drive member whereby the drive member positions the drive ring gear with at least some of the drive ring gear teeth disengaged from the first ring gear teeth. The drive ring gear and the first ring gear have different numbers of teeth. The other of the arms is selectively secured relative to the drive ring gear.

In a related aspect of the present invention, the other arm is secured to a second ring gear, and the drive ring gear includes an axially spaced second set of teeth, whereby the eccentric movement of the drive ring gear further positions the drive ring gear with at least some of the second set of drive ring gear teeth disengaged from the second ring gear teeth.

In yet another related aspect of the present invention, drive member has an outer surface oval about the second axis and the drive gear is flexible, whereby the oval surface flexes the drive gear to selectively engage the first and second ring gears with the first and second set of drive ring gear teeth, respectively, at substantially opposite sides.

In a further related aspect of the present invention, the eccentricity of the drive member forms the drive ring gear in a configuration in which the maximum diameter between the outer peaks of the first set of teeth of the drive ring gear is $D_1$ and the minimum diameter between the outer peaks of the first set of teeth of the drive ring gear is $d_1$. The drive member further forms the drive ring gear so that the maximum diameter between the outer peaks of the second set of teeth of the drive gear is $D_2$ and the minimum diameter between the outer peaks of the second set of teeth of the drive gear is $d_2$. The diameter between the inner peaks of the teeth of the first ring gear is no less than $d_1$ and no greater than $D_1$, and the diameter between the inner peaks of the teeth of the second ring gear is no less than $d_2$ and no greater than $D_2$.

It is an object of the invention to provide a window operator which may be used in existing installations.

It is another object of the invention to provide a window operator which may be simply and inexpensively manufactured and installed.

It is still another object of the invention to provide a window operator which may be simply and reliably operated over a long useful life.

It is yet another object of the invention to provide a window operator which provides smooth operation of the window sash, with minimal free travel of the sash.

Another object of the present invention is to provide a window operator which is highly resistant to corrosion in all environments.

Still another object of the present invention is to provide a window operator with minimal visual intrusion on the window opening.

Yet another object of the present invention is to provide a window operator having minimal risk of damage from accidental bumping.

Still another object of the present invention is to provide a window operator which provides safe and reliable positioning of the window sash.

DESCRIPTION OF THE PREFERRED EMBODIMENT

Figure 1:
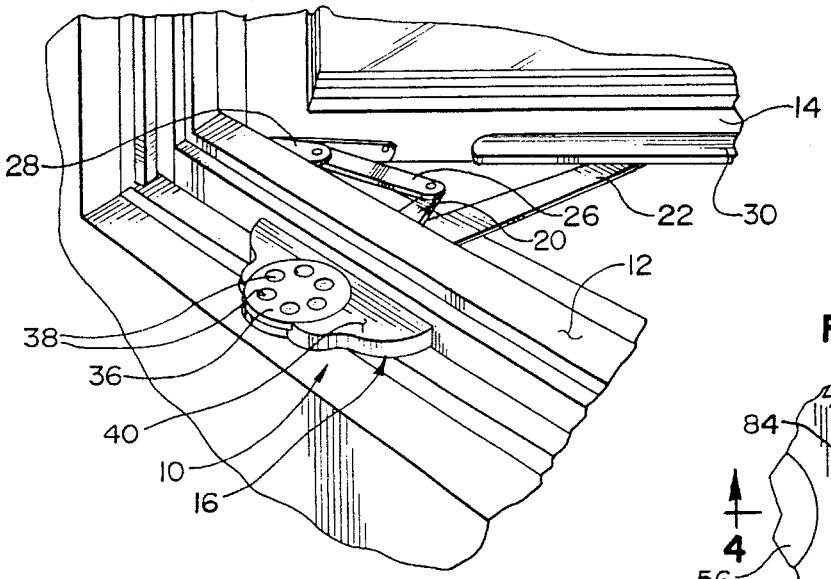
FIG. 1 is a perspective view of a window with the operator of the present invention.
Figure 3:
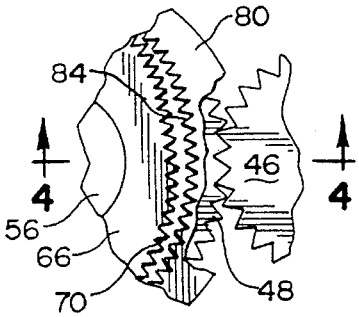
FIG. 3 is an enlarged partial view illustrating the drive structure of the operator of FIG. 2.
Figure 4:
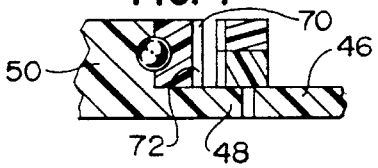
FIG. 4 is a cross-sectional view taken along line 4—4 of FIG. 3.

The operator 10 of the present invention is illustrated in FIG. 1 in conjunction with a window frame 12 and window sash 14. As shown, the operator 10 includes a base 16 secured to the frame 12 and pivots dual arms 20, 22 which are suitably linked to the window sash 14.

In the preferred embodiment illustrated in FIG. 1, the operator 10 functions by pivoting the dual arms 20, 22 relative to one another in order to move the sash 14. Such an operation can be accomplished by, for example, linking one arm 20 through a link 26 to a bracket 28 on one side of the window sash 14, and slidably connecting the other arm 22 to a track 30 secured to the bottom of the sash 14, for example by a roller (not shown). Such an arm configuration is shown, for example, in Van Klompenburg et al. U.S. Pat. No. 4,241,541, the disclosure of which is hereby incorporated by reference. Such arms 20, 22 work in conjunction with a suitable hinge structure (not shown) supporting the window sash 14 so that, as viewed in FIG. 1, the sash 14 can be closed against the frame 12 by pivoting the arms 20, 22 apart (i.e., by pivoting the one arm 20 counter-clockwise and the other arm 22 clockwise) whereby the one arm 20 through its link 26 pushes the sash 14 toward the left and the other arm 22 pulls the sash 14 against the frame 12. Opposite pivoting would, of course, open the sash 14. It will be recognized, however, from a full understanding of the invention disclosed there that many aspects of this invention could be realized with still different connections between the operator 10 and the sash 14, and that the present invention is not restricted to dual arm structures such as shown.

Figure 2:
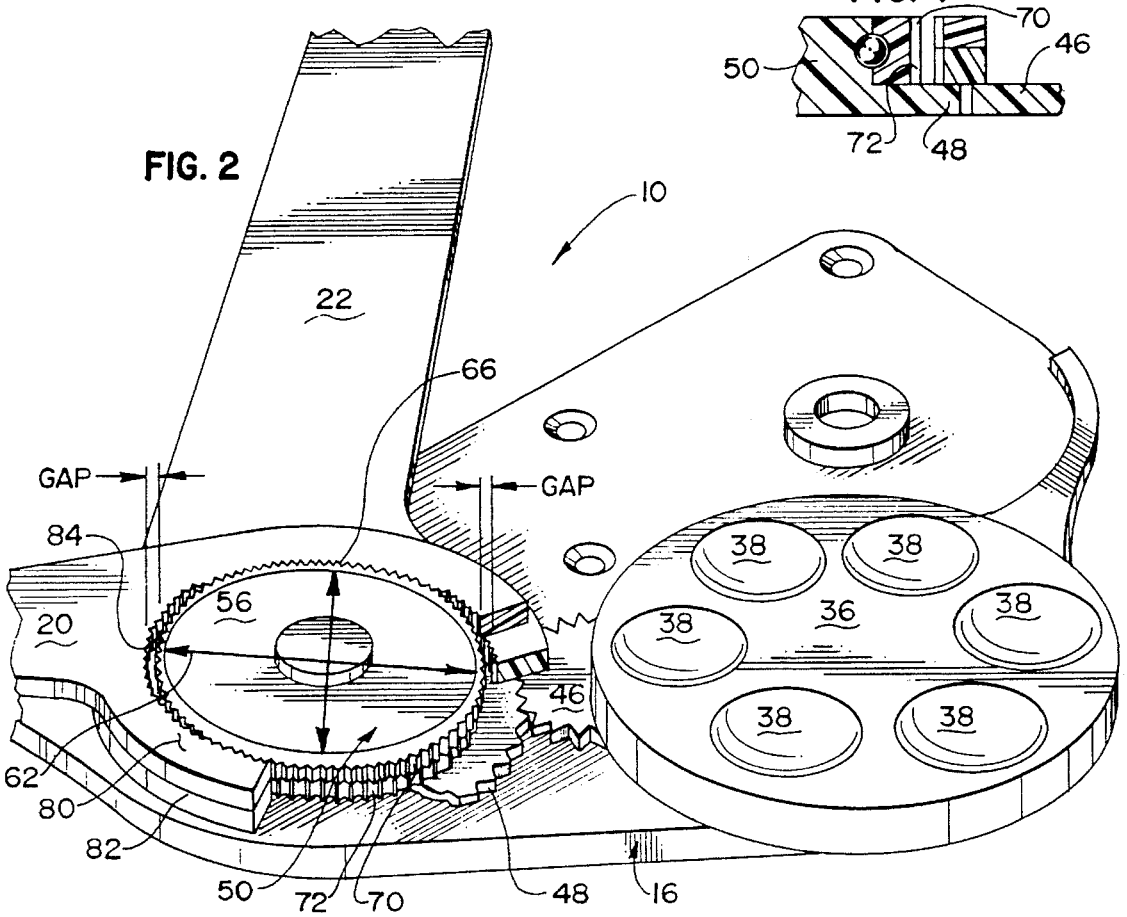
FIG. 2 is a perspective view showing a preferred form of the operator of the present invention.
Figure 5:
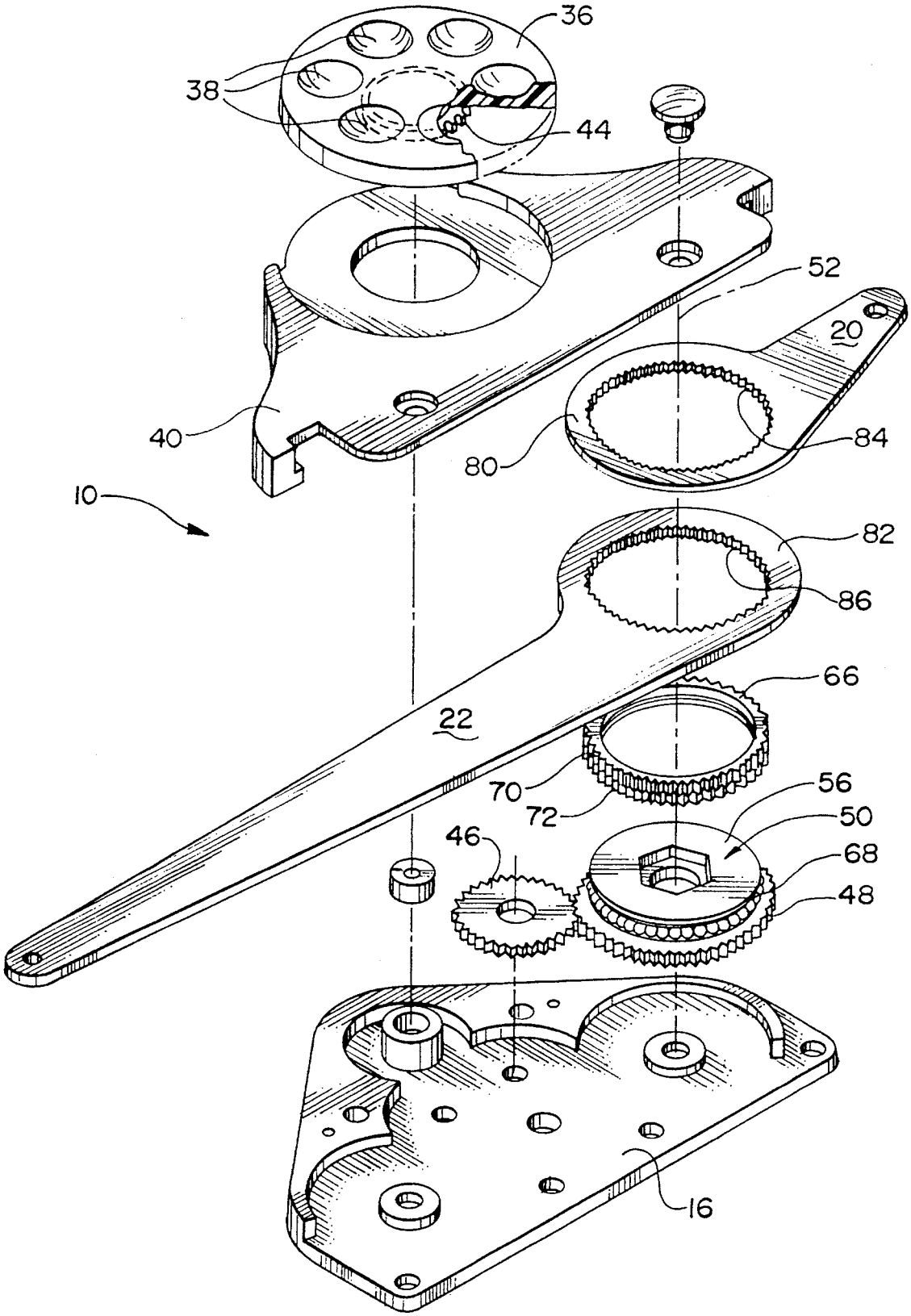
FIG. 5 is an exploded view showing the components of the preferred form of the operator shown in FIG. 2.

The operator base 16 (see FIGS. 2 and 5) is suitably secured to the frame 12, and pivotally supports a drive input 36 which is generally in the shape of an annular disk pivotal about its central axis. The drive input 36 includes a plurality of recesses 38 spaced in its upper surface about the pivot axis. A user may put the ends of his fingers in these recesses 38 and then rotate the drive input 36 in much the same manner as old telephone dials.

As can be readily seen from FIG. 1, the operator 10 with its housing 40 (see FIGS. 1 and 5) is thus minimally intrusive into the room. Thus, the desired aesthetic effect of the window opening is not impinged upon by the operator 10, which itself also provides an aesthetically pleasing appearance in the minimal space which it does occupy. Further, the operator 10 is low profile with virtually nothing sticking out (such as the handles used with many prior art manual operators) which might be accidentally bumped and therefore damaged and/or inadvertently opened. Of course, if unknowingly opened even a little, the resulting crack around the sash could result in significant heat losses therethrough, and further result in increase susceptibility (and danger) of the sash 14 toward forced entry.

Figure 6:
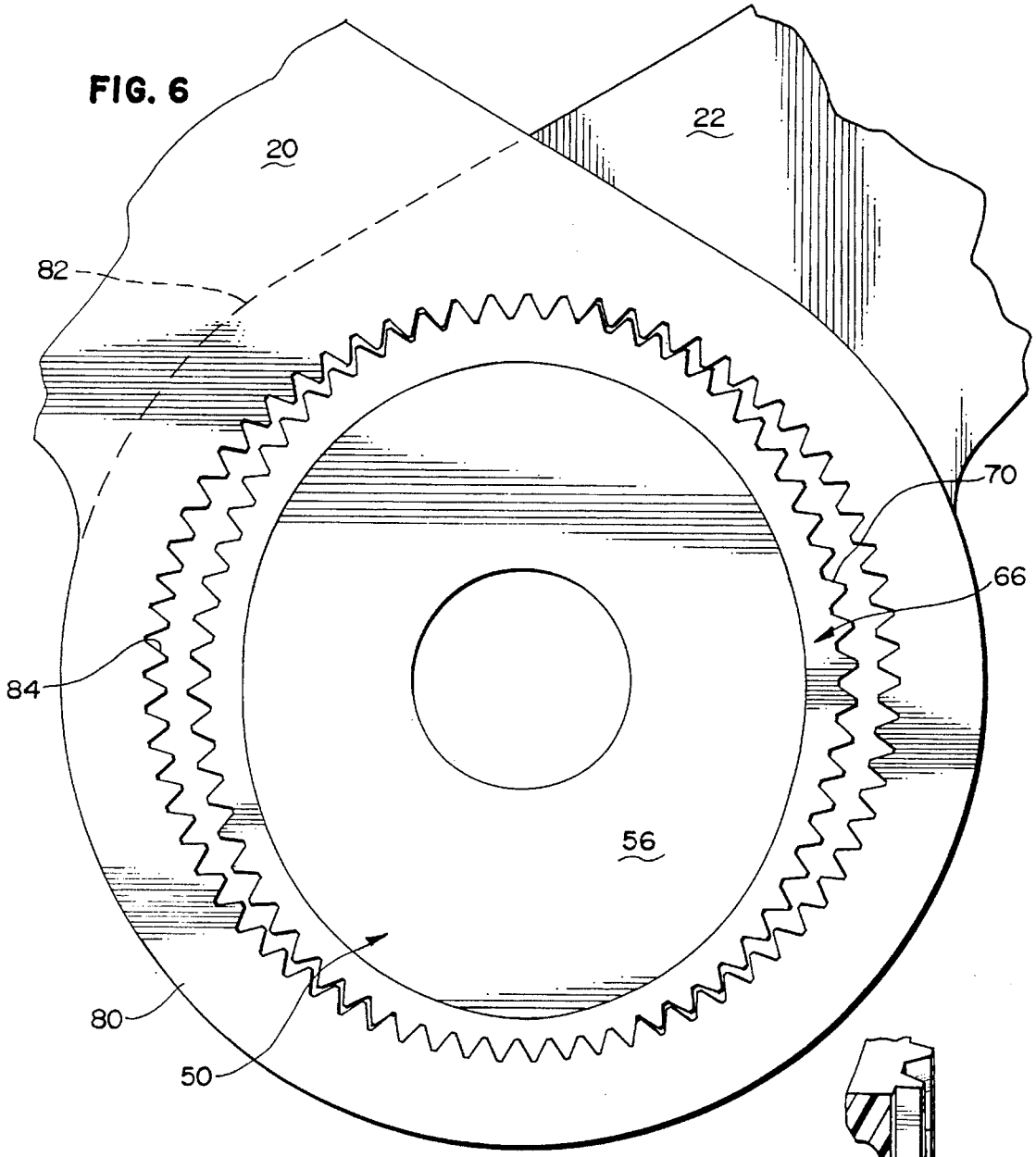
FIG. 6 is an enlarged top view of the drive structure of the FIG. 2 operator.
Figure 7:
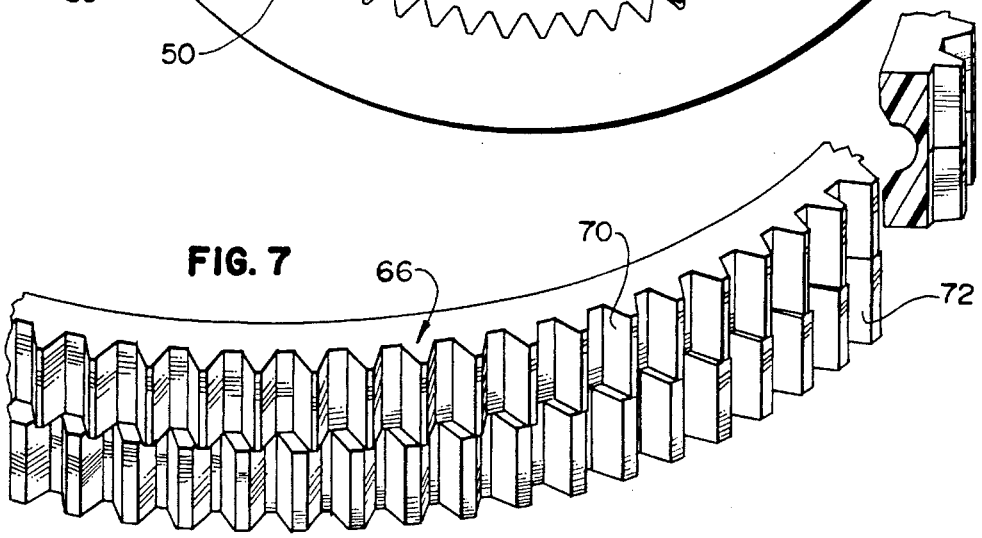
FIG. 7 is a perspective view of the drive ring gear of the FIG. 2 operator.

The drive input 36 includes a drive gear portion 44, which drives an idler gear 46 pivotally mounted to the base 16, which in turn drives the gear portion 48 of a drive member 50 which is pivotable about an axis 52 (see FIG. 5) fixed relative to the base 16. Extending upwardly from the drive member gear portion 48 is a portion 56 which is eccentric about the axis 52, such eccentricity being shown somewhat exaggeratedly in FIG. 6. That is, in a preferred form, the eccentric portion 56 is substantially oval shaped with a major axis 60 and minor axis 62 (see FIG. 2).

A flexible drive ring gear or spline 66 is disposed about the drive member eccentric portion 56 and has an inner circumference similar to the outer circumference of the eccentric portion 56, whereby the drive ring gear 66 is caused to have an oval shape similar to the eccentric portion 56. Suitable means such as ball bearings 68 (see FIG. 5) allow the drive ring gear 66 to pivot about the eccentric portion 56. The drive ring gear 66 includes two axially spaced sets of outwardly facing gear teeth 70, 72 which, in one preferred form and as described in greater detail hereafter, have different numbers of teeth.

The dual arms 20, 22 are each fixed to ring gears 80, 82, respectively, each ring gear 80, 82 having inwardly facing teeth 84, 86 and axially aligned with the first and second sets of outwardly facing gear teeth 70, 72, respectively. As seen in FIGS. 2–4 and 7, the ring gears 80, 82 are of a diameter where, in this preferred form, they engage the flexible drive ring gear teeth 70, 72 on opposite sides corresponding with the major axis 60 of the drive member eccentric portion 56, but on the opposite sides corresponding to the minor axis 62 of the drive member eccentric portion the drive ring gear teeth 70, 72 are radially clear of the ring gear teeth 84, 86. Also in one preferred form, the two ring gears 80, 82 have identical numbers of teeth 84, 86.

The above described structure thus forms a harmonic drive which can provide significant gear reduction in a very compact space. Such gear reduction thus allows a person to easily turn the drive input 36, using only one or more fingers to control the operator 10 notwithstanding the high forces often encountered when trying to move the sash 14 (particularly, for example, to break the weather seal when first opening the sash 14 or to form the weather seal when finally closing the sash 14).

For example, in one preferred form of the operator 10, both ring gears 80, 82 have eighty (80) teeth 84, 86, the first set of drive ring gear teeth 70 also includes eighty (80) teeth, and the second set of drive ring gear teeth 72 includes seventy-eight (78) teeth. With such a configuration, it should be recognized that the drive member eccentric portion 56 will cause the flexible drive ring gear 66 to essentially crawl around the inside of the ring gears 80, 82.

Since the ring gear 80 and its associated first set of drive ring gear teeth 70 both have the same number of teeth, the position of the ring gear 80 relative to the drive ring gear 66 will essentially be the same at the end of each revolution of the drive member 50. However, since the ring gear 82 and its associated second set of drive ring gear teeth 72 have different numbers of teeth (eighty vs. seventy-eight), the position of the ring gear 82 relative to the drive ring gear 66 will change with each revolution of the drive member 50. That is, at the end of each revolution of the drive member 50, the second set of drive ring gear teeth 72 will not have completely crawled around the ring gear 82, since it will have engaged only seventy eight of its eighty teeth 72. The end result is that for each revolution of the drive member, the dual arms 20, 22 will be pivoted relative to each other an amount essentially equal to 2/80 of a revolution—giving the harmonic drive a 1:40 reduction ratio. If a gear reduction of 1:2 is also provided from the drive gear portion 44 of the drive input 36 through the idler gear 46 to the gear portion 48 of the drive member 50, it should be appreciated that there would be a significant 1:80 gear reduction between the drive input 50 and the output (i.e., the pivoting of the arms 20, 22).

It should be recognized that when used with a dual arm operator structure as shown and described above, the significant requirement of the operator drive is merely to pivot the two arms 20, 22 relative to one another. The proper positioning of the arms 20, 22 will be established through their previously described link to the sash 14 in conjunction with the free rotation of the drive ring gear 66 about the drive member 50 (i.e., there is no need for the drive to specifically position one arm 20 in one position relative to the frame 12 when the other arm 22 is in another position—the proper positioning of the arms 20, 22 relative to the frame 12 through their range of motion when moving the sash 14 is essentially accomplished automatically).

It should also be recognized that certain of the advantages of the above described preferred embodiment of the invention could be obtained with variations on the above described drive. For example, such drive could use a flexible drive ring gear disposed outside outwardly facing ring gears on the arms, with a drive member eccentric portion disposed outside the flexible drive ring gear so as to push the teeth aligned with its minor axis into engagement with the ring gears.

It should further be recognized that the gear reduction ratio could be varied by the number of teeth, and the relative number of teeth, with the various gears. For example, a gear reduction could be provided where any three of the four sets of gear teeth (the first and second sets of drive ring gear teeth 70, 72 and the two ring gear teeth 84, 86) have the same number of teeth and the fourth has a different number of teeth. As another example, reduction could be provided where the first set of drive ring gear teeth 70 has X teeth, which is different than the number of teeth M of the first ring gear 80 and the second set of drive ring gear teeth 72 has Y teeth which is different than the number of teeth N of the second ring gear 82, where $M \neq N$ and/or $X \neq Y$. Put another way, one acceptable drive would use relative numbers of teeth whereby $(X-M)/X \neq (Y-N)/Y$.

As should be recognized from the above, it is preferred with the above described preferred embodiment that the differences in numbers of teeth of engaging gears be an even number (for example, the difference of two between the eighty and seventy-eight teeth in the described embodiment), since this allows the teeth where they engage on opposite sides associated with the major axis 60 of the eccentric portion 56 to readily align and mesh. Further, it should be recognized that in such drive each set of teeth 70, 72 of the drive ring gear 66 should have at least two teeth drivably engaging, at any given time, the teeth 84, 86 of their associated ring gears 80, 82. At the same time, it is preferred that many of those teeth are not in driving engagement, and still further that at least some of those teeth are radially clear from one another in order to allow the necessary clearance to allow the previously described "crawl" between associated gears having different numbers of teeth.

Still other variations on the preferred embodiment described above should also be recognized, as for example a structure in which the drive ring gear is not flexible, and is instead pivoted eccentricly about the drive member axis so as to engage the arm ring gears on only one side. Such a drive, in which the arm ring gears would need to be separately secured about their pivot axis (since, as contrasted with the previously described embodiment, the drive member would not itself secure the ring gears due to engagement on opposite sides thereof), In such a structure, it should be recognized that there would be no need for the differences in teeth to be an even number, and there would be a necessity to have only one tooth drivably engaging the associate gear.

It should thus be recognized that the window operator of the present invention may be simply and inexpensively manufactured and installed in many existing installations. Further, the significant gear reductions possible with the invention allow the operator to be simply and reliably operated over a long useful life, providing smooth operation of the window sash. Such gear reductions not only minimize the input forces required from a person, but also allow for the possibility of gears made of relatively inexpensive, easily formed material which is also highly resistant to corrosion in all environments. Also, this configuration allows the operator to be manually operated in a truly unique manner, with only fingertip control and input being required with the unique telephone dial-type drive input shown with the preferred embodiment.

Still further, operators embodying the present invention provide safe and reliable positioning of the window sash, with minimal free travel of the sash which might increase its susceptibility to damage and/or increase the chance that the window sash be unknowingly and undesirably closed without a proper weather seal. Moreover, the above significant advantages can be provided in a structure with only minimal visual intrusion on the window opening. Such minimal intrusion not only not only allows for ideal aesthetic characteristics, but also minimizes the risk of damage to the operator from accidental bumping.

Still other aspects, objects, and advantages of the present invention can be obtained from a study of the specification, the drawings, and the appended claims.

I claim:

1. An operator for controlling pivoting of a window sash relative to a window frame, comprising:

a linkage pivotable about an axis and connectable to said window sash for controlling movement of said window sash relative to said window frame;

a drive input pivotable about a first axis fixable relative to said window frame, said drive input being substantially in a shape of an annular disk and including multiple recesses therein spaced substantially evenly about the first axis and engageable by multiple of a user's fingers to manually pivot the drive input; and means drivably connecting the drive input to the linkage, said connecting means including a reduction ratio of at least 25:1.

2. An operator for controlling pivoting of a window sash relative to a window frame, comprising;

said linkage pivotable about an axis and connectable to said window sash for controlling movement of said window sash relative to said window frame;

a drive input pivotable about a first axis fixable relative to said window frame, said drive input including a recess spaced from the first axis and engageable by a user's finger to manually pivot the drive input; and means drivably connecting the drive input to the linkage, said connecting means including a reduction ratio of at least 25:1 and a harmonic drive.

3. An operator for controlling pivoting of a window sash relative to a window frame, comprising:

a linkage pivotable about an axis and connectable to said window sash for controlling movement of said window sash relative to said window frame, said linkage including first and second arms each having one portion engageable with said window sash;

a drive input pivotable about a first axis fixable relative to said window frame, said drive input including a recess spaced from the first axis and engageable by a user's finger to manually pivot the drive input; and means drivably connecting the drive input to the linkage, said connecting means including a reduction ratio of at least 25:1, said connecting means further including a pivotable drive member drivably connected to said drive input, said drive member being eccentric about its pivot axis, a first ring gear including gear teeth and securable to a second portion of said first arm, a drive ring gear including gear teeth and pivotable relative to said drive member, said drive ring gear being moved eccentrically relative to said pivot axis by said eccentric drive member whereby said drive member positions said drive ring gear with at least some of the drive ring gear teeth disengaged from the first ring gear teeth, and means for selectively securing said second arm relative to said drive ring gear, wherein said drive ring gear and said first ring gear have different numbers of teeth.

4. The operator of claim 3, wherein the drive ring gear is flexible, and the first ring gear teeth engage the drive ring gear at substantially opposite radial sides.

5. An operator for controlling pivoting of a window sash relative to a window frame, comprising:

a linkage pivotable about an axis and connectable to said window sash for controlling movement of said window sash relative to said window frame, said linkage including first and second arms each having one portion engageable with said window sash;

a drive input pivotable about a first axis fixable relative to said window frame, said drive input including a recess spaced from the first axis and engageable by a user's finger to manually pivot the drive input; and means drivably connecting the drive input to the linkage, said connecting means including a reduction ratio of at least 25:1, a pivotable drive member drivably connected to said drive input, said drive member being oval with a major axis and a minor axis, a flexible ring gear pivotably disposed about said oval drive member and having two axially spaced sets of outwardly facing teeth, a first ring gear having inwardly facing teeth and securable to another portion of the first arm, said first ring gear engaging the first set of teeth of the flexible ring gear at substantially the opposite radial sides associated with the drive member major axis, and a second ring gear having inwardly facing teeth and securable to another portion of the second arm, said second ring gear engaging the second set of teeth of the flexible ring gear at substantially the opposite radial sides associated with the drive member major axis, wherein at least said flexible ring gear first and second sets have different numbers of teeth or said first and second ring gears have different numbers of teeth.

6. The operator of claim 5, wherein both said first and second ring teeth sets include at least 75 teeth.

7. The operator of claim 5, wherein said drive input, said drive member, and said flexible ring gear are non-metallic.

8. The operator of claim 5, further comprising ball bearings between said drive member and said flexible ring gear.

9. The operator of claim 5, wherein:

the first and second sets of teeth of the flexible ring gear have outer peaks;

the diameter between the outer peaks of the first set of teeth of the flexible ring gear is $D_1$ between the teeth aligned with the drive member major axis and $d_1$ between the teeth aligned with the drive member minor axis;

the diameter between the outer peaks of the second set of teeth of the flexible ring gear is $D_2$ between the teeth aligned with the drive member major axis and $d_2$ between the teeth aligned with the drive member minor axis;

the teeth of the first and second gears have inner peaks;

the diameter between the inner peaks of the teeth of the first ring gear is no less than $d_1$ and no greater than $D_1$; and the diameter between the inner peaks of the teeth of the second ring gear is no less than $d_2$ and no greater than $D_2$.

10. An operator for controlling pivoting of a window sash relative to a window frame, comprising:

a linkage pivotable about an axis and connectable to said window sash for controlling movement of said window sash relative to said window frame, said linkage including first and second arms each having one portion engageable with said window sash;

a drive input pivotable about a first axis fixable relative to said window frame, said drive input including a recess spaced from the first axis and engageable by a user's finger to manually pivot the drive input; and means drivably connecting the drive input to the linkage, said connecting means including a reduction ratio of at least 25:1, a drive member drivably connected to said drive input and pivotable about a second axis, said drive member having a non-circular outer surface including one portion of said surface spaced further from said second axis than other portions of said surface, a base ring gear pivotably disposed about said eccentric drive member and having first and second axially spaced sets of outwardly facing teeth, a first ring gear pivotable about said second axis and securable to another portion of the first arm, said first ring gear having inwardly facing teeth and engaging the teeth of the base ring gear first set which are radially aligned with the one portion of the drive member surface, and a second ring gear pivotable about said second axis and securable to another portion of the second arm, said second ring gear having inwardly facing teeth and engaging the teeth of the base ring gear second set which are radially aligned with the one portion of the drive member surface, wherein at least one of said base ring gear first and second teeth sets and said first and second ring gears have different numbers of teeth.

11. The operator of claim 10, wherein the teeth of the first and second teeth sets have outer peaks, the teeth of the first and second ring gears have inner peaks, the maximum diameter between the outer peaks of the teeth of the first and second teeth sets is D, the first and second ring gears have a maximum radial overlap of $H_0$ when meshing with the teeth of the first and second teeth sets, and the teeth of at least one of said first and second ring gears have a diameter between the teeth inner peaks of no more than $D-H_0$.

12. A window, comprising:

a window frame;

a window sash;

means for securing said window sash to said window frame for movement between open and closed position;

an operator for controlling the movement of said window sash, said operator including a drive input pivotable about a first axis fixable relative to said window frame, said drive input including a recess spaced from the first axis and engageable by a user's finger to manually pivot the drive input;

a linkage pivotable about a second axis and connectable to the window sash for controlling movement of the window sash relative to the window frame, said linkage including first and second arms each having one portion engageable with said window sash; and means drivably connecting the drive input to the linkage, said connecting means including a reduction ratio of at least 25:1, a pivotable drive member drivably connected to said drive input, said drive member being eccentric about its pivot axis, a first ring gear including gear teeth and securable to a second portion of said first arm, a drive ring gear including gear teeth and pivotable relative to said drive member, said drive ring gear being moved eccentrically relative to said pivot axis by said eccentric drive member whereby said drive member positions said drive ring gear with at least some of the drive ring gear teeth disengaged from the first ring gear teeth, and means for selectively securing said second arm relative to said drive ring gear, wherein said drive ring gear and said first ring gear have different numbers of teeth.

13. The operator of claim 12, wherein the drive ring gear is flexible, and the first ring gear teeth engage the drive ring gear at substantially opposite radial sides.

14. A window, comprising:

a window frame;

a window sash;

means for securing said window sash to said window frame for movement between open and closed position;

an operator for controlling the movement of said window sash, said operator including a drive input pivotable about a first axis fixable relative to said window frame, said drive input including a recess spaced from the first axis and engageable by a user's finger to manually pivot the drive input;

a linkage pivotable about a second axis and connectable to the window sash for controlling movement of the window sash relative to the window frame, said linkage including first and second arms each having one portion engageable with said window sash; and means drivably connecting the drive input to the linkage, said connecting means including a reduction ratio of at least 25:1, a pivotable drive member drivably connected to said drive input, said drive member being eccentric about its pivot axis, a drive ring gear pivotably disposed about said pivotable drive member and including at least one set of outwardly facing gear teeth, means for selectively securing one of said arms relative to said drive ring gear, and a first ring gear having inwardly facing teeth and securable to another portion of the other of said arms, whereby said drive member positions said drive ring gear with less than half of the teeth of said one set in driving engagement with the first ring gear teeth, wherein the number of teeth of said one set is different than the number of teeth of the first ring gear.

15. The operator of claim 14, wherein the drive ring gear is flexible, and the first ring gear engages the one set of teeth of the drive ring gear at substantially opposite radial sides.

16. A window, comprising:

a window frame;

a window sash;

means for securing said window sash to said window frame for movement between open and closed position;

an operator for controlling the movement of said window sash, said operator including a drive input pivotable about a first axis fixable relative to said window frame, said drive input being substantially in a shape of an annular disk and including multiple recesses therein spaced substantially evenly about the first axis and engageable by multiple of a user's fingers to manually pivot the drive input;

a linkage pivotable about a second axis and connectable to the window sash for controlling movement of the window sash relative to the window frame; and means drivably connecting the drive input to the linkage, said connecting means including a reduction ratio of at least 25:1.

17. A window, comprising:

a window frame;

a window sash;

means for securing said window sash to said window frame for movement between open and closed and position;

an operator for controlling the movement of said window sash, said operator including a drive input pivotable about a first axis fixable relative to said window frame, said drive input including a recess spaced from the first axis and engageable by a user's finger to manually pivot the drive input;

a linkage pivotable about a second axis and connectable to the window sash for controlling movement of the window sash relative to the window frame; and means drivably connecting the drive input to the linkage, said connecting means including a reduction ratio of at least 25:1 and a harmonic drive.

18. The operator of claim 17, wherein:

said linkage comprises first and second arms each having one portion secured to the window sash; and said connecting means comprises a pivotable drive member drivably connected to said drive input, said drive member being oval with a major axis and a minor axis, a flexible ring gear pivotably disposed about said oval drive member and having first and second axially spaced sets of outwardly facing teeth, a first ring gear having inwardly facing teeth and securable to another portion of the first arm, said first ring gear engaging the first set of teeth of the flexible ring gear at substantially the opposite radial sides associated with the drive member major axis, and a second ring gear having inwardly facing teeth and securable to another portion of the second arm, said second ring gear engaging the second set of teeth of the flexible ring gear at substantially the opposite radial sides associated with the drive member major axis, wherein at least one of said flexible ring gear first and second teeth sets and said first and second ring gears have different numbers of teeth; and further comprising means for moving said window sash relative to the window frame in response to pivotal movement of the first arm relative to the second arm.

19. The operator of claim 18, wherein both said first and second ring teeth sets include at least 75 teeth.

20. The operator of claim 18, wherein said drive input, said drive member, and said flexible ring gear are non-metallic.

21. The operator of claim 18, further comprising ball bearings between said drive member and said flexible ring gear.

22. The operator of claim 18, wherein said securing means comprise hinges between said frame and said sash.

23. An operator for controlling pivoting of a window sash secured for opening and closing relative to a window frame, comprising:

a base mountable to the window frame;

a drive input pivotable about a first axis fixed relative to the base;

a drive member secured to the base for pivoting about a second axis in response to pivoting of the drive input, said drive member including an outwardly facing surface which is eccentric relative to the second axis;

a drive gear pivotably disposed about said drive member surface and having two axially spaced sets of outwardly facing gear teeth, said first set including X teeth and said second set including Y teeth;

a first arm securable to said window sash and on one end having a first ring gear with M inwardly facing teeth, said first ring gear being secured for pivoting about said second axis whereby said drive member eccentric surface positions less than half of the teeth of said drive gear first set in driving engagement with the first ring gear teeth;

a second arm securable to said window sash and on one end having a second ring gear with N inwardly facing teeth, said second ring gear being secured for pivoting about said second axis whereby said drive member eccentric surface positions less than half of the teeth of said drive gear second set in driving engagement with the second ring gear teeth;

wherein at least one of $X \neq Y$ and $M \neq N$ is true.

24. The operator of claim 23, wherein said drive input includes a recess spaced from the first axis and engageable by a user's finger to manual pivot the drive input.

25. The operator of claim 24, wherein said drive input is substantially in a shape of an annular disk and further comprising multiple recesses therein spaced substantially evenly about the first axis and engageable by multiple of a user's fingers to manually pivot the drive input.

26. The operator of claim 24, wherein said first and second axes are substantially parallel.

27. The operator of claim 23, wherein said eccentric surface is oval about the second axis and said drive gear is flexible, whereby said oval surface flexes said drive gear to selectively engage said first and second ring gears with the first and second set of teeth, respective, at substantially opposite sides.

28. The operator of claim 27, wherein:

the eccentric surface forms the drive gear in a configuration in which the maximum diameter between the outer peaks of the first set of teeth of the drive gear is $D_1$ and the minimum diameter between the outer peaks of the first set of teeth of the drive gear is $d_1$, and in which the maximum diameter between the outer peaks of the second set of teeth of the drive gear is $D_2$ and the minimum diameter between the outer peaks of the second set of teeth of the drive gear is $d_2$; and the diameter between the inner peaks of the teeth of the first ring gear is no less than $d_1$ and no greater than $D_1$, and the diameter between the inner peaks of the teeth of the second ring gear is no less than $d_2$ and no greater than $D_2$.

29. The operator of claim 23, wherein $X>75$ and $Y>75$.

30. The operator of claim 23, wherein said drive input, said drive member, and said drive gear are non-metallic.

31. The operator of claim 23, further comprising ball bearings between said drive member and said drive gear.

32. An operator for controlling pivoting of a window sash secured for opening and closing relative to a window frame, comprising:

a base securable to said window frame;

a drive input pivotable relative to the base;

a drive ring gear having an inner side and two axially spaced sets of outwardly facing gear teeth, said first set including X teeth and said second set including Y teeth;

a pivotable drive member drivably connected to the drive input and pivotable within the drive ring gear, said drive member including an eccentric outer surface at least a portion of which engages the drive ring gear inner side;

a first arm secured to a first ring gear with M inwardly facing teeth, said first ring gear being disposed about said first teeth set whereby said drive member eccentric surface positions between 1 and 0.5M teeth of said drive gear first set in driving engagement with the first ring gear teeth;

a second arm secured to a second ring gear with N inwardly facing teeth, said second ring gear being disposed about said second teeth set whereby said drive member eccentric surface positions between 1 and 0.5N teeth of said drive gear second set in driving engagement with the second ring gear teeth; and means for connecting the first and second arms to said window sash whereby pivoting of said arms relative to one another moves a connected window sash relative to a window frame;

wherein $(X-M)/X \neq (Y-N)/Y$.

33. The operator of claim 32, wherein said drive input is pivotable about a first axis and includes a recess spaced from the first axis and engageable by a user's finger to manual pivot the drive input.

34. The operator of claim 33, wherein said drive input is substantially in a shape of an annular disk, and further comprising multiple recesses in said drive input spaced substantially evenly about the first axis and engageable by multiple of a user's fingers to manually pivot the drive input.

35. The operator of claim 32, wherein:

said drive ring gear is flexible; and said drive member is pivotable about a second axis and said eccentric surface is oval about the second axis;

whereby said oval surface flexes said drive ring gear to selectively engage said first and second ring gears with the first and second set of teeth, respectively, at substantially opposite sides.

36. The operator of claim 35, wherein:

the eccentric surface forms the drive ring gear in a configuration in which the maximum diameter between the outer peaks of the first set of teeth of the drive gear is $D_1$ and the minimum diameter between the outer peaks of the first set of teeth of the drive gear is $d_1$, and in which the maximum diameter between the outer peaks of the second set of teeth of the drive gear is $D_2$ and the minimum diameter between the outer peaks of the second set of teeth of the drive gear is $d_2$; and the diameter between the inner peaks of the teeth of the first ring gear is no less than $d_1$ and no greater than $D_1$, and the diameter between the inner peaks of the teeth of the second ring gear is no less than $d_2$ and no greater than $D_2$.

37. The operator of claim 32, wherein $X>75$ and $Y>75$.

38. The operator of claim 32, wherein said drive input, said drive member, and said drive ring gear are non-metallic.

39. The operator of claim 32, further comprising ball bearings between said drive member and said drive ring gear.

40. An operator for controlling pivoting of a window sash relative to a window frame, comprising:

a linkage pivotable about an axis and connectable to said window sash for controlling movement of said window sash relative to said window frame;

a drive input pivotable about a first axis fixable relative to said window frame, said drive input including a recess spaced from the first axis and engageable by a user's finger to manually pivot the drive input, said drive input being substantially in a shape of an annular disk; and means drivably connecting the drive input to the linkage.

41. An operator for controlling pivoting of a window sash relative to a window frame, comprising:

a linkage pivotable about an axis and connectable to said window sash for controlling movement of said window sash relative to said window frame;

a drive input pivotable about a first axis fixable relative to said window frame;

means drivably connecting the drive input to the linkage, said connecting means including a reduction ratio of at least 25:1, said connecting means including a harmonic drive.

42. An operator for controlling pivoting of a window sash relative to a window frame, comprising:

a linkage pivotable about an axis and connectable to said window sash for controlling movement of said window sash relative to said window frame, said linkage including first and second arms each having one portion engageable with said window sash;

a drive input pivotable about a first axis fixable relative to said window frame; and means drivably connecting the drive input to the linkage, said connecting means including a reduction ratio of at least 25:1, a pivotable drive member drivably connected to said drive input, said drive member being eccentric about its pivot axis, a first ring gear including gear teeth and securable to another portion of said first arm, a drive ring gear including gear teeth and pivotable relative to said drive member, said drive ring gear being moved eccentrically relative to said pivot axis by said eccentric drive member whereby said drive member positions said drive ring gear with at least some of the drive ring gear teeth disengaged from the first ring gear teeth, and means for selectively securing said second arm relative to said drive ring gear, wherein said drive ring gear and said first ring gear have different numbers of teeth.

43. The operator of claim 42, wherein the drive ring gear is flexible, and the first ring gear teeth engage the drive ring gear at substantially opposite radial sides.

44. An operator for controlling pivoting of a window sash relative to a window frame, comprising:

a linkage pivotable about an axis and connectable to said window sash for controlling movement of said window sash relative to said window frame, said linkage including first and second arms each having one portion engageable with said window sash;

a drive input pivotable about a first axis fixable relative to said window frame; and means drivably connecting the drive input to the linkage, said connecting means including a reduction ratio of at least 25:1, a pivotable drive member drivably connected to said drive input, said drive member being oval with a major axis and a minor axis, a flexible ring gear pivotably disposed about said oval drive member and having two axially spaced sets of outwardly facing teeth, a first ring gear having inwardly facing teeth and securable to another portion of the first arm, said first ring gear engaging the first set of teeth of the flexible ring gear at substantially the opposite radial sides associated with the drive member major axis, and a second ring gear having inwardly facing teeth and securable to another portion of the second arm, said second ring gear engaging the second set of teeth of the flexible ring gear at substantially the opposite radial sides associated with the drive member major axis, wherein at least one of said flexible ring gear first and second sets and said first and second ring gears have different numbers of teeth.

45. The operator of claim 44, wherein both said first and second ring teeth sets include at least 75 teeth.

46. An operator for controlling pivoting of a window sash relative to a window frame, comprising:

a linkage pivotable about an axis and connectable to said window sash for controlling movement of said window sash relative to said window frame, said linkage including first and second arms each having one portion engageable with said window sash;

a drive input pivotable about a first axis fixable relative to said window frame; and means drivably connecting the drive input to the linkage, said connecting means including a reduction ratio of at least 25:1, a drive member drivably connected to said drive input and pivotable about a second axis, said drive member having a non-circular outer surface including one portion of said surface spaced further from said second axis than other portions of said surface, a base ring gear pivotably disposed about said eccentric drive member and having two axially spaced sets of outwardly facing teeth, a first ring gear pivotable about said second axis and securable to another portion of the first arm, said first ring gear having inwardly facing teeth and engaging the teeth of the base ring gear first set which are radially aligned with the one portion of the drive member surface, and a second ring gear pivotable about said second axis and securable to another portion of the second arm, said second ring gear having inwardly facing teeth and engaging the teeth of the base ring gear second set which are radially aligned with the one portion of the drive member surface, wherein at least one of said base ring gear first and second teeth sets and said first and second ring gears have different numbers of teeth.

47. The operator of claim 46, wherein the teeth of the first and second teeth sets have outer peaks, the teeth of the first and second ring gears have inner peaks, the maximum diameter between the outer peaks of the teeth of the first and second teeth sets is D, the first and second ring gears have a maximum radial overlap of $H_0$ when meshing with the teeth of the first and second teeth sets, and the teeth of at least one of said first and second ring gears has a diameter between the inner peaks of its teeth of no more than $D-H_0$.

48. An operator for controlling pivoting of a window sash relative to a window frame, comprising:

a linkage pivotable about an axis and connectable to said window sash for controlling movement of said window sash relative to said window frame, said linkage including first and second arms each having one portion engageable with said window sash;

a drive input pivotable about a first axis fixable relative to said window frame; and means drivably connecting the drive input to the linkage, said connecting means including a reduction ratio of at least 25:1, a pivotable drive member drivably connected to said drive input, said drive member being eccentric about its pivot axis, a drive ring gear pivotably disposed about said pivotable drive member and including at least one set of outwardly facing gear teeth, means for selectively securing one of said arms relative to said drive ring gear, and a first ring gear having inwardly facing teeth and securable to another portion of the other of said arms, whereby said drive member positions said drive ring gear with less than half of the teeth of said one set in driving engagement with the first ring gear teeth, wherein the number of teeth of said one set is different than the number of teeth of the first ring gear.

49. The operator of claim 48, wherein the drive ring gear is flexible, and the first ring gear engages the one set of teeth of the drive ring gear at substantially opposite radial sides.

* * * * *